US009073316B2

(12) United States Patent
Jin et al.

(10) Patent No.: US 9,073,316 B2
(45) Date of Patent: Jul. 7, 2015

(54) INKJET PRINTING POSITIONING DEVICE AND CONTROL METHOD THEREOF

(75) Inventors: Peng Jin, Beijing (CN); Feng Chen, Beijing (CN); Zhihong Liu, Beijing (CN)

(73) Assignees: Peking University Founder Group Co., Ltd., Beijing (CN); Peking University, Beijing (CN); Beijing Founder Electronics Co., Ltd., Beijing (CN); Peking University Founder R&D Center, Beijing (CN)

( * ) Notice: Subject to any disclaimer, the term of this patent is extended or adjusted under 35 U.S.C. 154(b) by 0 days.

(21) Appl. No.: 14/128,911

(22) PCT Filed: Aug. 7, 2012

(86) PCT No.: PCT/CN2012/079782

§ 371 (c)(1),
(2), (4) Date: Dec. 23, 2013

(87) PCT Pub. No.: WO2013/044689

PCT Pub. Date: Apr. 4, 2013

(65) Prior Publication Data

US 2014/0111572 A1 Apr. 24, 2014

(30) Foreign Application Priority Data

Sep. 30, 2011 (CN) ..... 2011 1 0299687

(51) Int. Cl.
*B41J 2/07* (2006.01)
*B41J 19/20* (2006.01)

(52) U.S. Cl.
CPC . *B41J 2/07* (2013.01); *B41J 19/205* (2013.01)

(58) Field of Classification Search
CPC ..... B41J 2/07; B41J 2/0458; B41J 2/04563; B41J 29/393; B41J 2/04591; B41J 2/04581
See application file for complete search history.

(56) References Cited

U.S. PATENT DOCUMENTS 5,861,726 A 1/1999 Uchikata et al.
6,109,721 A 8/2000 Kim (Continued)

FOREIGN PATENT DOCUMENTS

CN 1169551 A 1/1998
CN 1174126 A 2/1998
CN 101823378 A 9/2010

(Continued)

OTHER PUBLICATIONS

English translation from Google of CN 202242369.*

*Primary Examiner* — Manish S Shah
*Assistant Examiner* — Jeremy Delozier
(74) *Attorney, Agent, or Firm* — The Webb Law Firm

(57) ABSTRACT

This invention provides an inkjet printing positioning device and control method thereof. The inkjet printing positioning device comprises: base; linear guide rail fixedly mounted on the base; inkjet unit, moving in matched manner with the linear guide rail; ball screw, driving the inkjet unit to move linearly when being rotated; servomotor, for driving the ball screw to rotate; zero position detecting device, mounted in a position on the moving travel route of the inkjet unit from the initial position to the printing area, and for sending zero position signal when detects that the inkjet unit is passing by; controller connecting the zero position detecting device and the servomotor, and for controlling the servomotor to drive the inkjet unit to move from the current position to the printing area and locate there, and controlling the servomotor to drive the inkjet unit to move predetermined displacement upon receipt of zero position signal.

11 Claims, 2 Drawing Sheets

(56) References Cited

U.S. PATENT DOCUMENTS

| | | | | |
|---|---|---|---|---|
| 6,283,569 | B1 | 9/2001 | Otsuka et al. | |
| 8,449,104 | B2 * | 5/2013 | Okazawa | 347/104 |
| 2007/0035569 | A1 * | 2/2007 | Koto et al. | 347/14 |
| 2010/0225723 | A1 | 9/2010 | Okazawa | |
| 2011/0199419 | A1 * | 8/2011 | Hayashi | 347/19 |

FOREIGN PATENT DOCUMENTS

| | | | |
|---|---|---|---|
| CN | 202242369 | U | 5/2012 |
| TW | 201022051 | A | 6/2010 |

* cited by examiner

INKJET PRINTING POSITIONING DEVICE AND CONTROL METHOD THEREOF

CROSS-REFERENCE TO RELATED APPLICATIONS

This application is the United States national phase of International Application No. PCT/CN2012/079782 filed Aug. 7, 2012, and claims priority to Chinese Patent Application No. 201110299687.X filed Sep. 30, 2011, the disclosures of which are hereby incorporated by reference in their entirety.

FIELD OF THE INVENTION

The present invention relates to inkjet printing field. In particular, the present invention relates to an inkjet printing positioning device and control method thereof.

BACKGROUND OF THE INVENTION

In an inkjet printing device, in order to get graphics and text printed or overprinted accurately at certain fixed positions, printing positioning accuracy of the inkjet printing device is highly required. The conventional method solving the problem of printing accuracy or overprinting accuracy is to adjust the inkjet unit to locate above the printing or overprinting area, and then to adjust and control the corresponding nozzles of the printing head to print. In this way, graphics and text could be printed or overprinted accurately at certain fixed positions.

The inventors of the present invention find that, as the printing positioning is achieved by adjusting and controlling the nozzles of the printing head, some deficiencies may be resulted, for example, the utilization ratio of the nozzles of the printing heads may be reduced, the printing format may be affected, and the adjustment may cost more time, etc.

SUMMARY OF THE INVENTION

The object of the present invention is to provide an inkjet printing positioning device and the control method thereof, so as to achieve quick printing position of the inkjet printing device.

In an embodiment of the present invention, an inkjet printing positioning device is provided, which comprises: a base; a linear guide rail, which is fixedly mounted on the base; an inkjet unit, which moves in a matched manner with the linear guide rail; a ball screw, which drives the inkjet unit to move linearly when being rotated; a servomotor, which is used to drive the ball screw to rotate; a zero position detecting device, which is mounted in a position on the moving travel route of the inkjet unit from the initial position to the printing area, and is used to send a zero position signal when detects that the inkjet unit is passing by; a controller, which connects the zero position detecting device and the servomotor, the controller is used to control the servomotor to drive the inkjet unit to move from the current position to the printing area and locate there, and when a zero position signal is received, the servomotor is controlled to drive the inkjet unit to move a predetermined displacement.

In an embodiment of the present invention, a control method of an inkjet printing positioning device is also provided. The positioning device comprises a base; a linear guide rail, which is fixedly mounted on the base; an inkjet unit, which moves in a matched manner with the linear guide rail; a ball screw, which drives the inkjet unit to move linearly when being rotated; a servomotor, which is used to drive the ball screw to rotate; a zero position detecting device, which is mounted in a position on the moving travel route of the inkjet unit from the initial position to the printing area, and is used to send a zero position signal when detects that the inkjet unit is passing by; a controller, which connects the zero position detecting device and the servomotor, the method comprises: controlling the servomotor to drive the inkjet unit to move from the current position to the printing area and locate there, and controlling the servomotor to drive the inkjet unit to move a predetermined displacement when a zero position signal is received.

The inkjet printing positioning device and the control method thereof in the embodiments of the present invention described above achieve the printing positioning controlling by accurately controlling the displacement of the inkjet unit. In this way, the utilization ratio or effect of the nozzles of the printing head is not affected, and effect of automatic and quick printing positioning is obtained.

BRIEF DESCRIPTION OF DRAWING

The accompanying figures described below are in purpose of providing further understanding of the present invention and are part of the present application. The description of the schematic embodiments of the present invention is made only for the purpose of clear explanation rather than a limitation to the present invention.

DETAILED DESCRIPTION

The present invention is described in detail below with reference to the accompanying drawings and in combination with embodiments.

Figure 1:
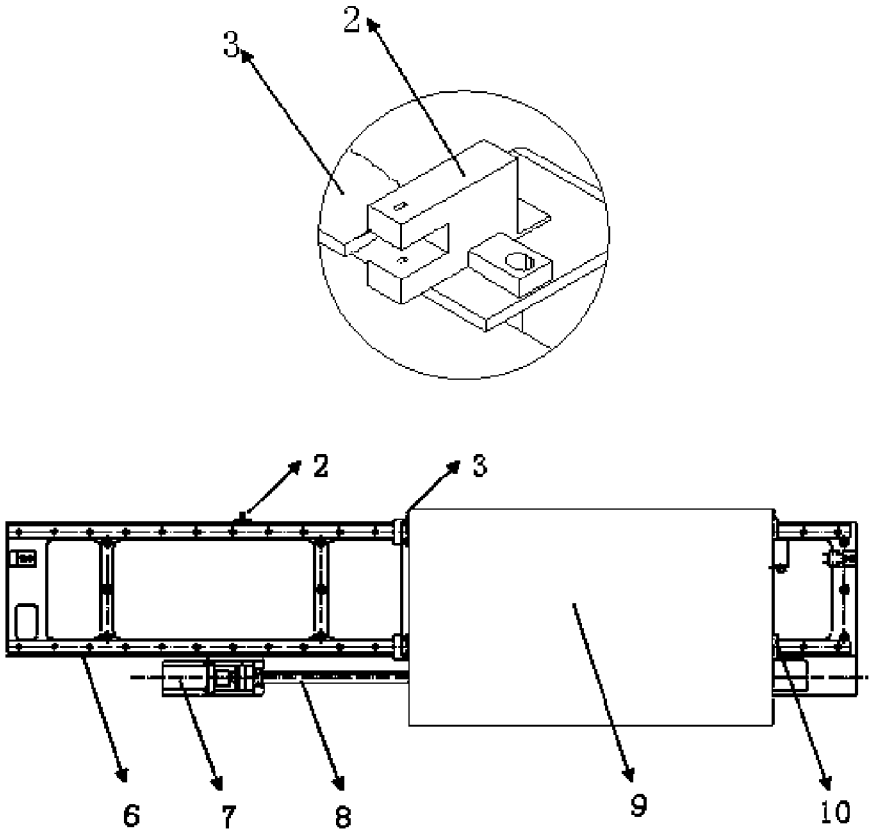
FIG. 1 shows an inkjet printing positioning device according to an embodiment of present invention.

FIG. 1 shows an inkjet printing positioning device according to an embodiment of present invention. The inkjet printing positioning device comprises: a base; a linear guide rail 6 which is fixedly mounted on the base; an inkjet unit 9 which moves in a matched manner with the linear guide rail 6.

The inkjet printing positioning device further comprises: a ball screw 8, which drives the inkjet unit 9 to move linearly on the linear guide rail 6 when being rotated; a servomotor 7, which is used for driving the ball screw 8 to rotate, for example, an AC servomotor can be chosen as the servomotor 7, and the AC servomotor 7 can be connected with ball screw 8 via a diaphragm coupler; zero position detecting devices 2 and 3, which are mounted in a position on the moving travel route of the inkjet unit 9 from a initial position to a printing area, and the zero position detecting devices 2 and 3 are used for sending a zero position signal when detects that the inkjet unit 9 is passing by; a controller, which connects the zero position detecting device and the servomotor 7, the controller is used for controlling the servomotor 7 to drive the inkjet unit 9 to move from the current position to the printing area and locate there. A predetermined displacement can be set in the controller. When a zero position signal sent from a zero position detecting device is received, the controller controls the servomotor 7 to drive the inkjet unit 9 to move the predetermined displacement, so as to locate the inkjet unit 9 at the inkjet printing position or overprinting position.

A conventional method for printing positioning is to adjust and control the nozzles of the inkjet head of the inkjet printing unit. The present invention, however, controls printing positioning by accurately controlling the displacement of the inkjet unit, thus, the utilization ratio of the nozzles of the inkjet head is not influenced, and a quick and automatic printing positioning is achieved.

In the operating process, the displacement setting can be adjusted in accordance with the result of making a proof, so as to achieve fine adjusting of printing positioning. In the present embodiment, printing position is located quickly and automatically by setting fine adjusting for the displacement setting of travel, which achieves accurate printing or overprinting positioning.

Preferably, there is a first block 3 on the inkjet unit 9, for example, the first block 3 is arranged at the left end of the inkjet unit 9 as shown in FIG. 1. The zero position detecting device comprises a first photoelectric switch 2, which is mounted on the base and arranged on the motion trace of the first block 3. The first photoelectric switch 2 has a slot, which can be used to fit the first block 3 to pass through. When the inkjet unit 9 is moving toward the printing area, the first block 3 passes through the slot provided on the first photoelectric switch 2, that will trigger the first photoelectric switch 2 so as to produce a photoelectric signal, that is, the zero position signal. When the zero position signal is received by the controller, the controller determines that the inkjet unit 9 arrives the zero position. According to preset program settings, the controller may control the servomotor 7 to rotate continually, so as to drive the inkjet unit 9 to move a preset displacement. Thus, the inkjet unit 9 can accurately arrive at a predefined inkjet printing position or inkjet overprinting position.

In the embodiment described above, the zero position where the first photoelectric switch 2 arranged is a reference position for calculating the displacement, as shown in FIG. 1. However, the first photoelectric switch 2 can also be set at any other position on the base, as long as the position of the first block 3 is adjusted or the displacement is adjusted accordingly.

Figure 2:
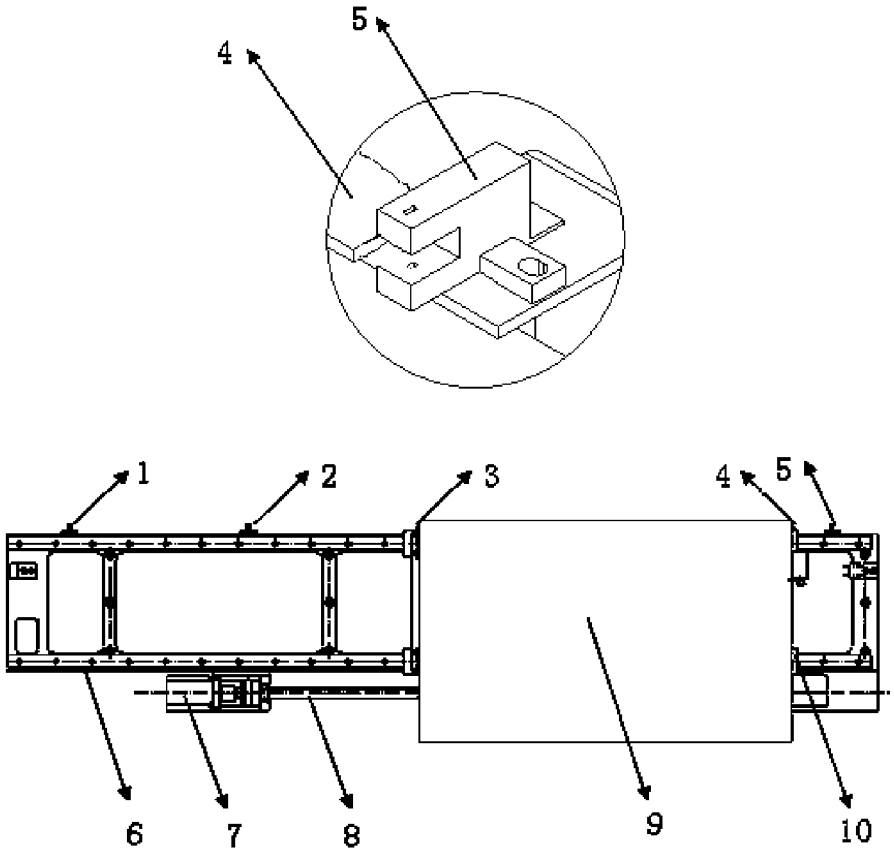
FIG. 2 shows an inkjet printing positioning device according to a preferable embodiment of present invention.

FIG. 2 shows an inkjet printing positioning device according to a preferable embodiment of present invention.

Preferably, as shown in FIG. 2, the present positioning device further comprises: an initial stopper 1, which is mounted between the position where the motion of the inkjet unit 9 starts and the position of the first photoelectric switch 2, the initial stopper 1 is used for sending zero position signal when detects that the inkjet unit 9 is passing by; additionally, the controller connects the initial stopper. The controller is also used for firstly controlling the servomotor 7 to drive the inkjet unit 9 to move towards the initial stopper, then, when the initial position signal from the initial stopper is received, the controller controls the servomotor 7 to drive the inkjet unit 9 to move towards the printing area.

AC servomotor 7 can be connected with the ball screw 8 via a diaphragm coupler. Preferably, in the present embodiment, AC servomotor 7 firstly drives the inkjet unit 9 to move to an initial position between the initial position of the motion and the zero position, and then move to the zero position. In this way, rotation error caused by axial clearance of the ball screw 8 could be reduced or eliminated effectively.

Preferably, the initial position detecting device comprises: a second photoelectric switch 1, which is mounted on the base, and located on the motion trace of the first block 3, the second photoelectric switch 1 has a slot, the first block 3 can be fitted into the slot and pass through it.

Preferably, when the controller receives the initial position signal sent by the initial position detecting device, the servomotor 7 is controlled to change its moving direction. This process prevents the movement of the inkjet unit 9 exceeds motion limit.

Preferably, as shown in FIG. 2, the present positioning device further comprises: an end position stopper, which is arranged at the end position of the travel of the inkjet unit 9 subtracting a safety margin, and is used for sending a end position signal when detects that the inkjet unit 9 is passing by. The controller also connects the end position stopper, so as to control the servomotor 7 to stop when receiving the end position signal, so as to prevent the movement of the inkjet unit 9 exceeds the motion limit Preferably, a second block 4 is provided on the inkjet unit 9, and the distance between the second photoelectric switch 1 and the first photoelectric switch 2 is less than the distance between the first block 3 and the second block 4, so as to prevent the second block 4 triggers the first photoelectric switch 2. The end position stopper comprises a third photoelectric switch 5, which is mounted on the base, and located on the motion trace of the second block 4, a slot is provided on the third photoelectric switch 5, the second block 4 can be fitted into and pass through that slot.

In FIG. 2, the second block 4 and the first block 3 are two separate blocks, thus the adjusting work could be convenient. However, the function of the second block 4 can also be achieved by the first block 3, as long as that the position of the third photoelectric switch 5 shall be arranged slightly forward.

In the embodiments above, photoelectric switches with slots, for example, the first photoelectric switch 2 and the second photoelectric switch 1, are used. Rectifier circuits or amplifier circuits may be provided in the slot of the photoelectric switches, so as to assure sensitivity of the photoelectric switches with slots.

In the preferred embodiment shown in FIG. 2, the steps below are used when the controller controls the servomotor to drive the ball screw to rotate so that the inkjet unit is positioning:

a) When the controller controls the servomotor 7 to drive the ball screw 8 to rotate so that the inkjet unit 9 moves towards the second photoelectric switch 1 accordingly, a corresponding electric signal sent by the first block 3 (that is the initial position signal) is detected by the second photoelectric switch 1; the controller then controls the servomotor 7 to drive the inkjet unit 9 to move towards the printing area;

b) Then, when the servomotor 7 drives the ball screw 8 to rotate, causing the inkjet unit 9 to move towards the first photoelectric switch 2 so as to eliminate rotation errors caused by the axial clearance of the ball screw 8, the corresponding electric signal sent by the first block 3 (namely, the zero position signal) is detected by the first photoelectric switch 2; the controller then controls the servomotor 7 to drive the inkjet unit 9 to continually move towards the printing area, and start to calculate the motion displacement of the inkjet unit 9;

c) At last, when the motion displacement of the inkjet unit 9 calculated by the controller is equal to the motion displacement set in the controller, the controller immediately controls the AC servomotor 7 to stop running, so as to achieve printing positioning of the inkjet unit 9.

According to the above description, the skilled persons in the art could understand that, in the embodiments of the present invention, in case that the controller controls the AC servomotor 7 to drive the inkjet unit 9 to move smoothly and steadily, automatic and quick positioning at the printing position can be done by setting fine adjustment for the motion displacement, and accurate printing or overprinting positioning can be achieved. Compared with the related art, the preferred embodiments of the present invention provide a more simple adjusting method, working time for adjusting printing positioning is substantially reduced, more accurate printing or overprinting positioning is achieved, meanwhile, the utilization ratio of the nozzles of the inkjet head is not affected, and the problems of low utilization ratio of the nozzles of the inkjet head and taking more time in adjustment etc., in the conventional method are resolved.

The description above is only the preferred embodiment of the present invention, and the preferred embodiment should not be regarded as to be restrictive. For those skilled persons in the art, it is possible to make various modifications or changes. Various modifications or equivalent substitution to the present invention without departing from the spirit of the present invention should be within the protection of the present invention.

The invention claimed is:

1. An inkjet printing positioning device comprising: a base; a linear guide rail, which is fixedly mounted on the base; a inkjet unit, which moves in a matched manner with the linear guide rail, further comprising:

a ball screw, which is used to drive the inkjet unit to move linearly when being rotated;

a servomotor, which is used to drive the ball screw to rotate;

a zero position detecting device, which is mounted in a position on the moving travel route of the inkjet unit from the initial position to the printing area, and used for sending a zero position signal when detects that the inkjet unit is passing by; and a controller, connecting the zero position detecting device and the servomotor, for controlling the servomotor to drive the inkjet unit to move from a current position to the printing area and locate there, and the controller controls the servomotor to drive the inkjet unit to move a predetermined displacement when a zero position signal is received by the controller.

2. The device according to claim 1, further comprising a first block provided on the inkjet unit, with the zero position detecting device comprising:

a first photoelectric switch, which is mounted on the base, in a position on the moving travel route of the first block, and the first photoelectric switch has a slot to which the first block can be fitted in and pass through.

3. The device according to claim 2, further comprising:

an initial stopper, which is mounted between the first photoelectric switch (2) and an initial position on the moving travel route of inkjet unit, with the initial stopper used to send an initial position signal when the inkjet unit passing by is detected;

the controller further connecting the initial stopper, used for firstly controlling the servomotor to drive the inkjet unit to move towards the initial stopper, then controlling the servomotor to drive the inkjet unit to move towards the printing area when the initial position signal is received.

4. The device according to claim 3, wherein the initial position detecting device comprises:

a second photoelectric switch, which is mounted on the base, located in a position on the moving travel route of the first block, and the second photoelectric switch has a slot to which the first block can be fitted in and pass through.

5. The device according to claim 3, wherein when the initial position signal is received by the controller, the servomotor is controlled to change direction.

6. The device according to claim 2, further comprising:

an end position stopper, which is located at the end position of the motion of the inkjet unit subtracting a safety margin, used for sending an end position signal when the inkjet unit passing by is detected; and the controller also connecting the end position stopper, for controlling the servomotor to stop when receiving the end position signal.

7. The device according to claim 6, further comprising a second block provided on the inkjet unit, with the distance between the second photoelectric switch and the first photoelectric switch being less than the distance between the first block and the second block; and wherein the end position stopper comprises:

a third photoelectric switch, which is mounted on the base, located on the moving travel route of the second block; and a slot is provided on the third photoelectric switch, to which the second block can be fitted in and pass through.

8. A method of controlling an inkjet printing positioning device, with the positioning device comprising: a base; a linear guide rail, which is fixedly mounted on the base; an inkjet unit, which moves in a matched manner with the linear guide rail; a ball screw, which drives the inkjet unit to move linearly when being rotated; a servomotor, which is used for driving the ball screw to rotate; a zero position detecting device, which is mounted in a position on the moving travel route of the inkjet unit from the initial position to the printing area, and used for sending a zero position signal when detects that the inkjet unit is passing by; a controller, connecting the zero position detecting device and the servomotor, the method comprising:

controlling the servomotor to drive the inkjet unit to move from the current position to the printing area and locate there, and the controlling the servomotor driving the inkjet unit to move a predetermined displacement when the zero position signal is received.

9. The method according to claim 8, wherein a first block is provided on the inkjet unit, and the zero position detecting device comprises:

a first photoelectric switch, which is mounted on the base, located in a position on the moving travel route of the first block, the first photoelectric switch has a slot to which the first block can be fitted in and pass through.

10. The method according to claim 9, wherein the positioning device comprises an initial stopper, which is mounted between the first photoelectric switch and an initial position on the moving travel route of the inkjet unit, the initial stopper is used for sending an initial position signal when the inkjet unit passing by is detected; the controller further connects the initial stopper, the positioning process for the controller controlling the servomotor to drive the inkjet unit to move from the current position to the printing area comprises:

firstly, the controller controls the servomotor to drive the inkjet unit to move towards the initial stopper; then, when the initial position signal is received, the controller controls the servomotor to drive the inkjet unit to move towards the printing area.

11. The method according to claim 8, wherein the positioning device further comprises: an end position stopper, which is located at the end position of the motion of the inkjet unit subtracting a safety margin, for sending an end position signal when the inkjet unit passing by is detected; the controller also connects with the end position stopper, and the method further comprises:

controlling the servomotor to stop when the end position signal is received.

* * * * *